US008544552B2

(12) United States Patent
Davidson

(10) Patent No.: US 8,544,552 B2
(45) Date of Patent: Oct. 1, 2013

(54) SYSTEM FOR PULSE-INJECTING FLUID INTO A BOREHOLE

(75) Inventor: Brett Charles Davidson, Cambridge (CA)

(73) Assignee: Wavefront Reservoir Technologies Ltd., Cambridge, Ontario (CA)

( * ) Notice: Subject to any disclaimer, the term of this patent is extended or adjusted under 35 U.S.C. 154(b) by 8 days.

(21) Appl. No.: 12/989,719

(22) PCT Filed: Apr. 30, 2009

(86) PCT No.: PCT/CA2009/000557

§ 371 (c)(1),
(2), (4) Date: Oct. 26, 2010

(87) PCT Pub. No.: WO2009/132433

PCT Pub. Date: Nov. 5, 2009

(65) Prior Publication Data

US 2011/0036581 A1 Feb. 17, 2011

(30) Foreign Application Priority Data

Apr. 30, 2008 (GB) ..... 0807878.4

(51) Int. Cl.
*E21B 34/06* (2006.01)

(52) U.S. Cl.
USPC ..... 166/373; 166/319

(58) Field of Classification Search
USPC ..... 166/373, 386, 319, 320, 321, 177.1, 166/177.7; 137/494
See application file for complete search history.

(56) References Cited

U.S. PATENT DOCUMENTS

| | | | | | |
|---|---|---|---|---|---|
| 2,670,801 | A * | 3/1954 | Sherborne | 166/249 |
| 3,987,848 | A * | 10/1976 | Canterbury | 166/321 |
| 3,993,129 | A * | 11/1976 | Watkins | 166/319 |
| 4,342,364 | A * | 8/1982 | Bodine | 166/249 |
| 4,364,446 | A * | 12/1982 | Thomas et al. | 181/120 |
| 4,628,996 | A * | 12/1986 | Arnold | 166/116 |
| 4,793,417 | A * | 12/1988 | Rumbaugh | 166/312 |
| 5,040,155 | A * | 8/1991 | Feld | 367/85 |
| 5,073,877 | A * | 12/1991 | Jeter | 367/84 |
| 5,103,430 | A * | 4/1992 | Jeter et al. | 367/85 |
| 5,297,631 | A * | 3/1994 | Gipson | 166/299 |
| 5,836,393 | A * | 11/1998 | Johnson | 166/308.1 |
| 6,234,770 | B1 * | 5/2001 | Ridley et al. | 417/408 |

(Continued)

OTHER PUBLICATIONS

Dictionary defintions of "backup" and "replacement", accessed Jan. 3, 2013, via www.thefreedictionary.com.*

*Primary Examiner* — Shane Bomar
*Assistant Examiner* — Blake Michener
(74) *Attorney, Agent, or Firm* — Anthony Asquith Corp.

(57) ABSTRACT

For injecting e.g. water into ground formation around a borehole, and for superimposing pulses onto the outflow of the injected water, it is important that the pulses have a rapid rise-time. A piston is connected to a pulse-valve of the tool. A bias spring urges the piston towards its closed position. The piston is urged towards the open position by a differential PDAF between the supplied accumulator-pressure and the in-ground formation-pressure. When the pulse-valve is open, the PDAF is falling, until the force of the spring closes the pulse-valve. Then the PDAF rises, but now the PDAF acts over only a small area of the piston. When the PDAF is high enough to ease the pulse-valve open, suddenly the whole area of the piston is exposed to the PDAF, whereby the pulse-valve opens violently.

14 Claims, 2 Drawing Sheets

(56) References Cited

U.S. PATENT DOCUMENTS

| | | | | |
|---|---|---|---|---|
| 6,241,019 | B1 * | 6/2001 | Davidson et al. | 166/249 |
| 6,250,388 | B1 * | 6/2001 | Carmi et al. | 166/311 |
| 6,695,049 | B2 * | 2/2004 | Ostocke et al. | 166/97.1 |
| 6,877,566 | B2 * | 4/2005 | Selinger et al. | 166/373 |
| 7,007,865 | B2 * | 3/2006 | Dodd | 239/225.1 |
| 7,404,416 | B2 * | 7/2008 | Schultz et al. | 137/835 |
| 7,405,998 | B2 * | 7/2008 | Webb et al. | 367/84 |
| 7,614,452 | B2 * | 11/2009 | Kenison et al. | 166/321 |
| 7,748,462 | B2 * | 7/2010 | Reid | 166/323 |
| 7,806,184 | B2 * | 10/2010 | Schultz et al. | 166/305.1 |
| 8,037,940 | B2 * | 10/2011 | Patel et al. | 166/386 |
| 8,316,944 | B2 * | 11/2012 | Pringle et al. | 166/320 |
| 2002/0017384 | A1 * | 2/2002 | Ostocke et al. | 166/85.1 |
| 2003/0079913 | A1 * | 5/2003 | Eppink et al. | 175/61 |
| 2003/0234107 | A1 * | 12/2003 | Floyd | 166/320 |
| 2005/0178558 | A1 * | 8/2005 | Kolle et al. | 166/373 |
| 2006/0196665 | A1 * | 9/2006 | LaGrange et al. | 166/298 |
| 2006/0278395 | A1 * | 12/2006 | Kenison et al. | 166/312 |
| 2007/0227731 | A1 * | 10/2007 | Contant | 166/278 |
| 2008/0302528 | A1 * | 12/2008 | Samaroo et al. | 166/249 |
| 2011/0036581 | A1 * | 2/2011 | Davidson | 166/305.1 |

* cited by examiner

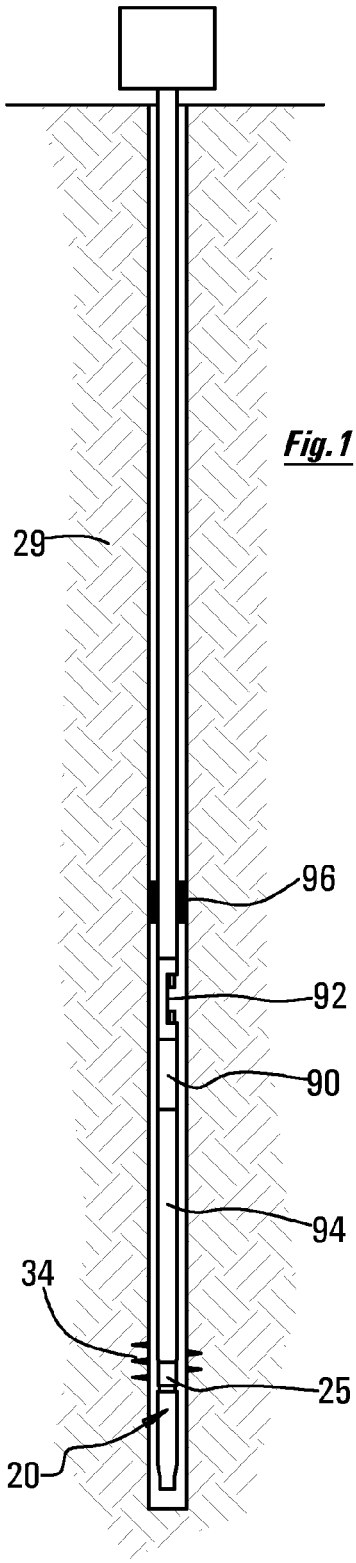
Fig.1
Fig.4
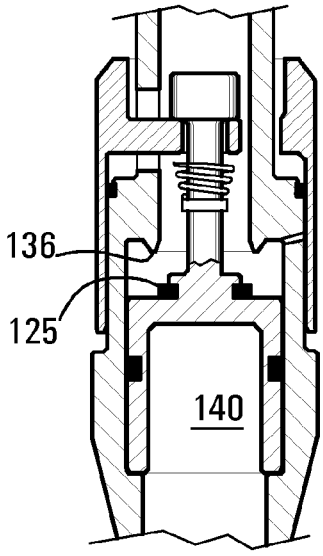

SYSTEM FOR PULSE-INJECTING FLUID INTO A BOREHOLE

The technology described herein is a development of the technology disclosed in patent specification PCT/CA-2009/00040, and provides another manner for enabling liquid to be injected out into the ground formation around a borehole, and for enabling pulses to be imposed onto the liquid being injected.

LIST OF THE DRAWINGS

FIG. 1 is a cross-sectioned elevation of a borehole, into which a pulsing tool has been lowered.

FIG. 4 shows a manner of arranging a seal in an upper surface of a piston of the tool.

Figure 2:
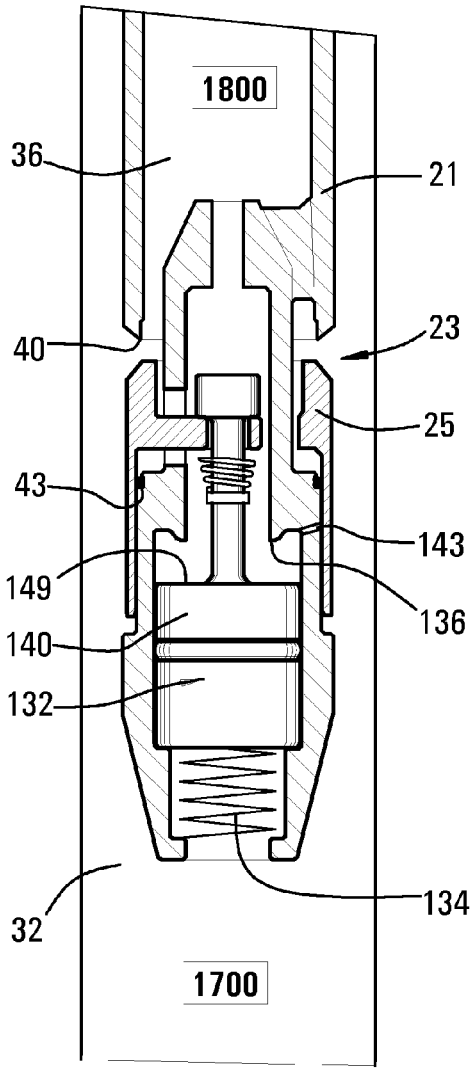
FIG. 2 is a cross-section of the pulsing tool, shown in the condition in which a pulse-valve of the tool is about to close.

The pulsing tool 20 of FIG. 2 includes a pulse-valve 23 and a vertically-sliding valve-member 25. In FIG. 2, the pulse-valve is shown in its open position. The valve-member 25 is connected to a hammer 132, and the valve-member moves in conjunction with movements of the hammer. The hammer 132 includes a piston 140, having upwards-facing surfaces 149, which are exposed to the pressure that is present in the accumulator-space 36 of the tool. The downwards-facing undersurfaces 139 of the hammer 132 are exposed to the pressure in the formation-space 32, which is connected (through the perforations 34, see FIG. 1) to the outside formation.

A hammer-spring 134 acts to bias the hammer 132 in an upwards direction, and the hammer 132 remains DOWN (FIG. 2) so long as the force acting downwards on the hammer, due to the pressure in the accumulator-space 36, exceeds the sum of the force due to the hammer-spring 134 and the force acting upwards on the hammer due to the pressure in the formation-space 32. Alternatively, or additionally, the piston can be biased by means of compressed gas.

In FIG. 2, the pulse-valve being open, liquid is passing from the accumulator-space 36, through the open pulse-valve 23, into the formation-space 32, and out into the formation. Thus, after the valve has been open for a time (typically, a second or so), a charge-volume of injected liquid has entered the formation, whereby the pressure in the accumulator-space has fallen (to 1800 pressure units (termed psi) in the example as shown) and the pressure in the formation-space has risen (e.g. to 1700 psi). The differential of pressure between the accumulator-pressure and the formation-pressure herein is termed the PDAF.

Now, the differential PDAF has fallen to such a low value (being 100 psi in FIG. 2) that the force acting to urge the hammer 132 upwards (being the hammer-spring force) is now greater than the force due to the PDAF acting upon the piston 140, to urge the piston (and hence the hammer) downwards.

Figure 3:
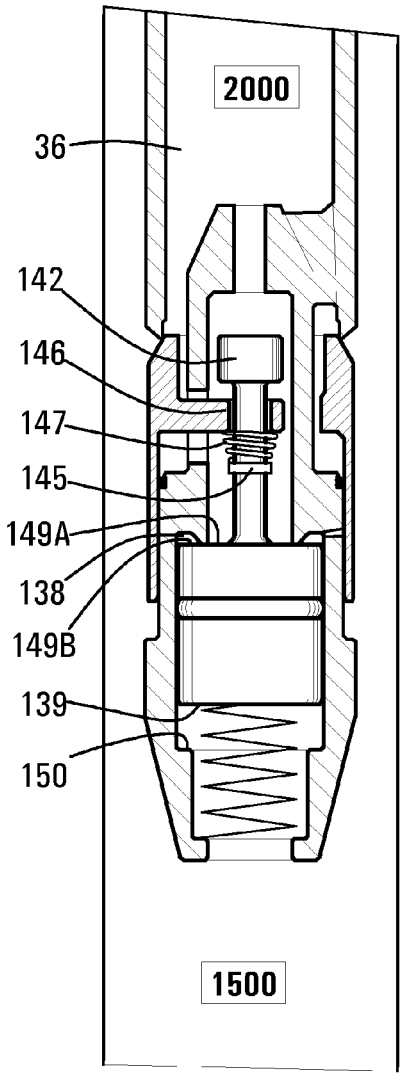
FIG. 3 is the same as FIG. 2, but is now shown in the condition in which the pulse-valve is about to open.

Therefore, in FIG. 2, the differential PDAF has fallen to such a low level that the hammer 132 is about to rise, and the pulse-valve 23 is about to close. The position of the components in the pulse-valve-closed condition is shown in FIG. 3.

Once the pulse-valve 23 is closed, liquid is prevented from passing out into the formation. Therefore, the formation-pressure (i.e. the pressure in the formation-space 32) starts to fall (down from 1700 psi towards 1500 psi in the example). Equally, since the pulse-valve is closed, the accumulator now can re-charge, pressurised liquid being supplied from the surface. The accumulator-pressure (i.e. the pressure in the accumulator-space 36) therefore starts to rise (up from 1800 psi towards 2000 psi in the example). Thus, the pulse-valve being closed, in FIG. 3, the pressure differential PDAF, between the formation-pressure and the accumulator-pressure, increases—to 500 psi in FIG. 3.

The stationary body 21 of the tool 20 includes an abutment-ring 136. The abutment-ring serves as an area-divider with respect to the upwards-facing surface (i.e. the accumulator-surface 149) of the piston body 140 of the hammer 132. With the pulse-valve 23 closed, and the hammer 132 in its UP position (FIG. 3), accumulator-pressure acts (downwards) on the small sub-area 149A of the accumulator-surface that lies inside the abutment-ring 136. The annular space 138 outside the abutment-ring 136 (i.e. the space above sub-area 149B of the accumulator-surface of the piston) does not contain accumulator-pressure at this time, being sealed therefrom by the contact between the abutment-ring 136 and the accumulator-surface 149 of the piston 140 of the hammer 132. In fact, the annular space 138 communicates with the formation-pressure via a small equalization-hole 143, and thus is exposed to the (lower) formation-pressure.

The formation-pressure acts upwards against the downwards-facing surface (the formation-surface 139) of the piston 140 of the hammer 132. The designer has arranged that, when the pressure differential PDAF exceeds an upper trigger level (being 500 psi in the example of FIG. 3), the now-high PDAF acting on the small sub-area 149A just slightly exceeds the force due to the hammer-spring 134. So, now, the hammer 132 eases downwards a fraction.

Once the hammer starts to moves downwards, now the abutment-ring 136 no longer seals against the accumulator-surface of the piston 140 of the hammer 132. Therefore, the high accumulator-pressure now suddenly acts over the whole upwards-facing accumulator-surface of the piston, being the sum of sub-area 149A and sub-area 149B together, and not just over the sub-area 149A. The result is that the large (500 psi) pressure differential PDAF now slams the hammer 132 downwards.

The head 142 of the fast-moving (and accelerating) hammer 132 strikes the hub 146 of the valve-member 25 with a good deal of momentum, with the result that the pulse-valve 23 opens very rapidly. Operationally, the connection between the piston and the valve-member is set up as a lost-motion connection, whereby the hammer has already had the opportunity to accelerate, and to reach a high speed, before it slams into the hub 146. Its high momentum therefore makes the valve-member 25 move downwards very rapidly.

With the pulse-valve 23 open, liquid from the accumulator surges out through the perforations 34 (shown in FIG. 1), and out into the formation 29. As explained in PCT/CA-2009/00040, the violent rapidity of the initial opening of the pulse-valve 23 produces a porosity-wave, which propagates out into the formation. The more violent the opening of the pulse-valve, i.e. the faster the rise-time of the pressure pulse, the more energetically the porosity-wave can be expected to penetrate out into the formation.

The pulse-valve 23, having opened, and having created the porosity-wave, now remains open, whereby a charge-volume of liquid passes out into the formation. In due course, the accumulator-pressure drops and the formation-pressure rises. After a time, the flowrate of liquid slows, and the differential PDAF between the (rising) formation-pressure and the (falling) accumulator-pressure drops down to 100 psi—the condition shown in FIG. 2. Now, once again, the hammer-spring 134 can overcome the now-small pressure differential PDAF and can raise the hammer 132 and the valve-member 25, whereupon the pulse-valve 23 once more closes.

When the hammer 132 rises, a collar 145 picks up the valve-member 25, and drags the valve-member upwards to its closed position. (The valve-member 25 would not tend to return to its closed position on its own.) A collar-spring 147 provides some compliance between the hammer and the valve-member—which is preferred because the valve-member must be closed tightly against its seat 40 at the same time as the upper end of the piston 140 of the hammer is closed tightly against the abutment-ring 136.

Once the valve-member 25 has moved to its closed position, the designers can arrange for the valve-member to remain closed by providing that the effective diameter of the seal of the valve-member against the seat 40 of the tool body 21 is slightly smaller than the diameter of the skirt seal 43. The (small) difference gives rise to a (small) force urging the sliding valve-member upwards when it is in its closed position.

It will be understood that the arrangement of FIGS. 2, 3 is able to produce useful on-going cyclic opening and closing of the pulse-valve, as follows. When the hammer 132 is UP (and the seal at the abutment-ring 136 is made) the pressure differential PDAF now only acts over the small upwards-facing area 149A of the piston 140—whereas, when the hammer is DOWN (and the hammer is clear of the abutment-ring 136) the PDAF now acts over the whole area of the piston.

Therefore, when the hammer is UP (whereby the pulse-valve is closed), the PDAF has to increase to a large magnitude (500 psi in the example) in order to make the hammer start to move downwards, whereas, when the hammer is DOWN (whereby the pulse-valve is open), now the PDAF must decrease to a low magnitude (100 psi) in order to make the hammer move upwards.

In order to effect a seal at the abutment-ring 136, the designer can arrange for the metal of the abutment-ring 136 to abut against the metal of the surface 149 of the hammer 132, as shown in FIGS. 2, 3. Alternatively, an elastomeric seal can be let into a groove in the surface 149, against which the ring 136 abuts. Alternatively again, as shown in FIG. 4, an elastomeric seal 125 is fitted around a neck of the hammer 132, for engagement with the abutment-ring 136 when the piston 140 rises.

The designer should arrange for the seal at the abutment-ring 136 to be leakproof, because even a slight leakage under the abutment-ring 136, when the seal is supposed to be closed, would or might enable the pressure in the annular-space 138 to rise, and thus affect the ability of the apparatus properly to perform the up/down cyclic movements of the hammer, as described.

During its up/down cyclic movements, the hammer 132 is slammed downwards very rapidly, and the designer should consider including e.g. an elastomeric buffer between the hammer and the shoulder 150, to function as a shock-absorber. Or, the designer might arrange a hydraulic cushion for the hammer.

One of the benefits of the arrangement of FIGS. 2, 3 is that the cyclic speed or frequency of pulsing is self-adjusting. Therefore, the designers need not be concerned with devising an operable control for changing the pulse-cycling frequency.

When the pulse-valve opens, as described, a charge-volume of water (or other liquid, or even a gas in some circumstances) is injected out into the surrounding aquifer formation. Now, if the ground is very permeable, a comparatively large charge-volume is needed, in order to fill up the aquifer with enough water at a high enough pressure for the pressure differential PDAF to decrease to the lower level at which the pulse-valve closes—and it takes a long time for this large charge-volume to pass through the pulse-valve, which means that it takes a long time for the PDAF to decrease all the way down to 100 psi, being the condition that triggers the end of the injection stroke. This extended injection-stroke means that the frequency of pulsing would be comparatively slow.

On the other hand, when the ground is comparatively impermeable, and/or approaching complete over-saturation, now only a small charge-volume is needed, per pulse-cycle, to fill up the surrounding aquifer sufficiently that the PDAF can decrease to the low magnitude (100 psi) at which the pulse-valve closes.

In the apparatus of FIGS. 2, 3, the opening and closing of the pulse-valve 23 is dictated by the pressure differential PDAF. The pulse-valve closes when (i.e. the pulse-valve remains open until) the PDAF has decreased to 100 psi. Equally, the pulse-valve opens when (i.e. the pulse-valve remains closed until) the PDAF has increased to 500 psi. If the nature of the ground, and/or the degree of saturation and over-saturation of the ground, are such that the PDAF can change rapidly, then the pulse frequency is fast and the charge-volume injected per pulse is small. If the ground and/or its degree of saturation are such that the PDAF can change only slowly, i.e. if a large charge-volume needs to be injected in order to effect the required change in PDAF, then pulsing takes place at a slow frequency.

The designers choose the limits for the upper and lower magnitudes of the PDAF (being the 500 psi and the 100 psi magnitudes in the example) at which they desire the pulse-valve to open and close. The designers put the desired opening and closing pressures into practical effect by selecting the diameters and areas of the components of the apparatus that are moved by the various pressures and differential pressures, and by selecting appropriate spring-forces and spring-rates etc.

The designers having determined the upper and lower limits that the PDAF has to reach, in order to trigger the pulse-valve to open and close, the arrangement of FIGS. 2, 3 ensures that the pulse-valve remains open for just the right time period as will ensure cycling between the large PDAF (at which the pulse-valve opens) and small PDAF (at which the pulse-valve closes).

It might happen, when injection first commences, that the ground is able to accept injected liquid at so low a back-pressure that the PDAF does not change enough to initiate cycling between upper and lower trigger levels, and the tool then does not create pulses. Eventually, the ground does become saturated enough for the PDAF to change fast enough for pulsing to commence.

However, it is usually preferred not to continue with the non-pulsed injection for a long period because steady-pressure (or static) injection can lead to extensive fingering of the injected liquid out into the ground formation, and it can be quite difficult to homogenize (or re-homogenize) the ground formation and the liquid content thereof, once fingering has become established. Therefore, the prudent engineer, faced with the prospect of a long period of injection without pulsing, can include an injection check-valve 90 in the overall tool, e.g. of the kind as described with reference to FIGS. 11, 12 of PCT/CA-2009/00040. Also, in cases where it is desired to permit a static or non-pulsed injection flow into the formation, in addition to the pulsed injection, the designer can include a static injection sub-assembly 92 in the overall tool, e.g. of the kind as described with reference to FIGS. 13, 13*a* of PCT/CA-2009/00040.

The term saturation, as used herein, may be explained as follows. The ground formation is said to be simply-saturated when no more liquid can be injected into the ground, without pulsing, and without increasing the injection pressure. Usually, in the type of ground formation with which the present technology is mainly concerned, the saturation condition cannot actually be achieved; that is to say, it is always possible to inject some more liquid, e.g. at a slow flowrate, because injected liquid is constantly dissipating into the surrounding ground at a slow flowrate.

It is (nearly) always possible to inject more liquid into the ground simply by raising the steady (non-pulsing) injection pressure. However, engineers must take care not to raise the injection pressure above the maximum pressure permitted for that borehole and ground formation. The permissible limit is put in place on the basis that applying a higher pressure would or might lead to irreversible physical damage to the ground formation. Usually, the maximum permitted pressure should not be exceeded even during a pressure pulse of very short duration. It may be noted that although the rapid opening of the pulse-valve creates the energetic porosity wave, it does not cause the pressure to rise even momentarily above the permitted maximum.

Generally, the engineers will wish to inject as much liquid into the ground as possible, at as rapid a rate as possible. Therefore, they will wish to inject the liquid at as high a pressure as possible. It is therefore common for the engineers to carry out injection at a pressure magnitude that is just under the permitted pressure level, for that borehole and that ground formation.

Thus, again, the simple-saturation condition occurs when injecting liquid at a steady rate, i.e. without pulsing (termed static injection), and when the rate at which further liquid can be injected has slowed to zero, at a given injection pressure, or at least has slowed to a commercially-insignificant trickle. Again, the pressure at which the liquid is injected will usually be the maximum pressure that the ground formation can stand. If injection at a higher pressure were permitted, it would be done—on the basis that the faster the liquid can be placed in the ground, the more economical the injection operation.

The term over-saturation, as used herein, refers to the injection of more liquid into the ground, beyond the simple-saturation condition. This extra injectability results from applying pulses to the liquid as the liquid is being injected. Practically any type of pulsing can enable at least a small degree of over-saturation; the technology described herein, particularly the engineered rapid rise-time of the pulses, when performed properly, can enable a very large degree of over-saturation to be achieved.

It is emphasized that the extra injectability attributable to pulsing still takes place within the maximum permitted injection-pressure. During static-injection, the liquid is maintained at its maximum permitted pressure all the time; during pulse-injection, the liquid is cycled between its maximum permitted pressure and a somewhat lower pressure. Nevertheless, pulse-injecting enables more liquid to be injected than static-injecting, for a given injection-pressure.

For the purposes of this specification, the ground is said to be fully or completely over-saturated when, after a long period of pulse-injection, every drop of liquid that is injected into the formation during the injection-stroke of the pulse-cycle travels back into the borehole during the recovery-stroke of the pulse-cycle. Again, in real practical ground formations, the fully over-saturated condition is never quite achieved, i.e. the volume recovered, per pulse, is never quite as much as the volume injected per pulse.

Again, it is generally the aim of the designers and engineers to inject as much liquid as possible into the ground, per well, in as short a time as possible. In practical terms, it will always be possible to inject some more liquid into the well, after a time, because the already-injected liquid dissipates somewhat into the surrounding ground. As to when to stop injecting, that is a matter of the economics of the particular injection operation.

Sometimes, the pulsing tool includes a component that can be recognized as a dedicated accumulator structure, having a spring or a contained volume of gas that is compressed by rising pressure during the recharge-phase. An example is shown in FIGS. 9. 10 of PCT/CA-2009/00040. In FIG. 1, the dedicated accumulator structure 94 is provided when the designer wishes to create or provide a large store of pressurized liquid close to the tool. When the pulse-valve opens, the presence of the accumulator structure ensures that there is ample volume of pressurized liquid available to be injected, at high pressure. However, in some cases a dedicated accumulator structure is not needed, and the accumulator-pressure is simply the pressure in the downpipe from the surface to the tool, through which liquid is delivered to the tool.

The term accumulator-pressure, as used herein, is the supply pressure as it acts on the movable piston of the injection tool. The accumulator-pressure is derived from liquid fed down to the tool from the surface. The accumulator-pressure decreases during the injection phase of the injection-cycle, when the pulse-valve is open and liquid is passing out into the formation. The accumulator-pressure increases during the recovery- or recharge-phase of the cycle, when the pulse-valve is closed, and the accumulator is being recharged by pressurized liquid from the surface.

The term formation-pressure, as used herein, is the pressure in the ground formation, as it acts on the movable piston of the tool. The formation-pressure is rising or increasing during the injection-phase of the injection-cycle, when the pulse-valve is open and liquid is passing out into the formation. The formation-pressure is falling or decreasing during the recovery- or recharge-phase of the cycle, when the pulse-valve is closed.

As mentioned, the PDAF is the pressure differential between the accumulator-pressure and the formation-pressure.

The upper and lower trigger levels are the levels of the PDAF at which the tool triggers the pulse-valve 23 to switch from closed to open, and triggers the pulse-valve to switch from open to closed, respectively. The magnitudes of the PDAF at the respective trigger levels are determined by the force of the hammer-spring 134 and by the sizes of area-A 149A and of area-B 149B, as in:— upper trigger (pulse-valve opens)=when the rising PDAF reaches HSF/area-A;

lower trigger (pulse-valve closes)=when the falling PDAF drops to HSF/(area-A+area-B).

(The hammer-spring force (HSF) would be greater for the lower level, because the hammer-spring 134 is more compressed at that time.)

The above relationships apply to FIGS. 2, 3, in which, when the pulse-valve 23 is closed, the area-B 149B is exposed to the formation-pressure. In an alternative tool, in which the designer has provided that the area-B is exposed to some other pressure, the relationship would be different.

The working range of pressure of the tool is the difference between the upper trigger level of the PDAF (at which the pulse-valve opens) and the lower trigger level (at which the pulse-valve closes). In the example of FIGS. 2, 3, the upper trigger level is 500 psi and the lower trigger level is 100 psi, so the working range is 400 psi.

When the ground formation is not at all saturated, the back pressure in the formation, against which the liquid is injected, is more or less zero—or, at least, the back pressure drops to an insignificant level (almost) immediately upon closure of the pulse-valve.

During the early stages of pulsing, when the ground is unsaturated, desirably the working range of the tool should be large. As a saturation condition is approached, so the residual back pressure (i.e. the formation-pressure against which the liquid is injected) rises. The working range of the tool might have to be reduced as the saturation condition is approached.

For example, consider the case of a tool that is operating in a well in a ground formation for which the permitted maximum injection pressure is 2000 psi. The tool has been structured to provide a working range of 1500 psi, between the upper trigger level of the PDAF and the lower trigger level. That is to say: the pulse-valve opens and closes cyclically between two PDAF pressures that are 1500 psi apart. Thus, if the formation-pressure is e.g. 400 psi, the pulse-valve opens when the accumulator-pressure reaches 1900 psi.

If the residual back pressure of the formation were to rise higher than 400 psi, say to 600 psi, now the upper trigger level would be set to occur at an accumulator-pressure of 2100 psi—which is higher than the maximum permitted pressure for that borehole, and higher than the supply pressure. Therefore, the pulse-valve would not open unless/until the formation-pressure falls below 500 psi.

In reality, the formation-pressure would indeed eventually fall to 500 psi, as the injected liquid dissipated into the formation. However, the intention behind liquid-injection generally is to inject as much liquid as possible into the ground, as rapidly as possible. Simply waiting for the injected liquid to drain away would be contra-indicated. So, when approaching saturation, it is preferred that the tool set-up should be changed in such manner as to reduce the working range of the tool. For example, the working range might be reduced from 1500 psi down to e.g. 400 psi (as shown in the example of FIGS. 2, 3).

Still further reductions in the working range may be made, as the condition of complete over-saturation is approached. It is up to the operators to determine the most cost-effective number and size of the steps by which the working range of the tool should be reduced, as injection proceeds, depending on the particular tool, on the particular ground formation, and on the cost associated with taking the tool out of the ground and changing its hammer-spring or other components.

In some cases, it is commercially worthwhile still to pulse-inject liquid into the ground even when the formation-pressure is only just below the maximum permitted injection pressure—say when the formation-pressure has risen to 1800 psi or 1900 psi with a permitted maximum injection pressure of 2000 psi. Now, given that the upper and lower trigger PDAF levels are quite close together, the hammer-spring has to be very light, and the area-B has to be small, in order for the upper and lower trigger levels to be close enough together for the tool to actually perform the injection/recharge cycle.

Preferably, the designer should arrange for the working range to be changed simply by changing the hammer-spring. The lighter the hammer-spring, the smaller the working range. In the design as shown, it is a simple matter to arrange the tool such that the tool can be dismantled, in the field, sufficiently to enable the hammer-spring to be changed. Also, optionally the working range of the tool can be adjusted by changing the ratio between the area of Area-A and the area of area-B.

Again, also, optionally the rate of the hammer-spring can be changed in order to change the open/close triggers of the tool. If the hammer-spring is of a low rate, the spring exerts nearly the same force during opening as it exerts during closing. If the spring is of a high rate, the force exerted on the piston by the spring at the moment of closing (when the spring is more compressed) is higher than the force exerted by the same spring at the moment of opening. Thus, the rate of the hammer-spring can be used to affect the PDAF levels at which the pulse-valve opens and closes.

The tool as shown has to be removed from the well, in order for the engineers to change the spring, or to change the pistons etc. However, it is routine for a pulse-injection tool to be removed from the injection-well from time to time, during a pulse-injection program, and the engineers can usually arrange for the changes to the hammer-spring to coincide with those occasions.

The frequency at which the tool operates its inject/recharge cycle of course depends on the parameters of the pulse-valve, but depends also on the permeability of the ground. The tighter the ground, the smaller the volume of liquid that needs to be injected in order for the formation-pressure to rise to a given level. The engineers should see to it that the pumping etc equipment is adequate for the task of injecting at the needed flowrate and pressure. The engineers preferably should see to it that the pump and other liquid supply facilities, at the surface, are capable of charging up the accumulator at a faster flowrate than the ground formation can accept the liquid at the corresponding pressures. The cyclic frequency settles to the level as determined by the time it takes for the PDAF to rise to the upper trigger level, and to fall to the lower trigger level.

With a typical design of pulsing tool, and in a typical well, the frequency of pulsing might vary between e.g. one or two cycles per second, and e.g. one cycle in ten seconds. Typically also, pulsing would be continued over a period of days or weeks. It might take several days, or a few hours, for a back-pressure to build up in the formation, such that there is some measurable residual pressure left in the formation-space immediately before the pulse-valve opens.

Again, it is emphasized that, during a pulse-injection operation, the accumulator-pressure and the formation-pressure are not static. Rather, when the pulse-valve is closed, the accumulator-pressure is rising and the formation-pressure is falling; when the pulse-valve is open, the formation-pressure is rising and the accumulator-pressure is falling. The PDAF also is constantly changing; the PDAF rises when the pulse-valve is closed, and falls when the pulse-valve is open.

The valve-member 25 moves between the valve-open and the valve-closed positions, and it is important that the distance the valve-member has to move should be short, in order for the pulse-valve to open as rapidly as possible. The area of the throat of the open pulse-valve is the product of the circumference and the axial distance through which the valve-member travels. The designer preferably should therefore arrange for the circumference of the pulse-valve to be as large as conveniently possible, in order to minimize the distance traveled, and this preference has been followed in the design as depicted.

There is little point in the throat area of the open pulse-valve being larger than the throat area of the passageways and conduits leading from the accumulator to the pulse-valve. In a downhole tool having an overall area OA, typically the passageways and conduits have an area of 0.6 or 0.7 OA, and the area of the open pulse-valve should be the same. Therefore, the valve-member being close to the outer diameter of the tool, the distance the valve-member moves should be between about 0.12 and 0.18 of the overall diameter of the tool.

The attached drawings show the tool components diagrammatically. Of course, the designer must see to it that the components can actually be manufactured, and can be assembled together.

Terms of orientation, such as "above", down", and the like, when used herein are intended to be construed as follows. When the terms are applied to an apparatus, that apparatus is distinguished by the terms of orientation only if there is not one single orientation into which the apparatus, or an image of the apparatus, could be placed, in which the terms could be applied consistently.

The scope of the patent protection sought herein is defined by the accompanying claims. The apparatuses and procedures depicted in the accompanying drawings and described herein are examples.

The numerals appearing in the accompanying drawings are:

20 pulsing tool
21 body of tool
23 pulse-valve
25 sliding valve-member
29 formation
32 formation-space
34 perforations in well casing
36 accumulator-space
40 end of tool body
43 skirt seal of 25
90 injection check-valve
92 static injection sub-assembly
94 accumulator structure
96 packer
125 seal
132 hammer
134 hammer-spring
136 abutment-ring
138 annular space outside 136
139 downwards-facing formation-surface of 140
140 piston
142 head of 132
143 equalization hole
145 collar on 132
146 hub of 25
147 collar-spring
149 upwards-facing accumulator-surface of 140
149A area-A of 149
149B area-B of 149
150 shoulder

The invention claimed is:

1. Tool having an operational capability to superimpose pulses onto a pressurized stream of fluid being injected into a ground formation, wherein:

the tool includes a pulse-valve, having a pulse-valve-member that is movable between a valve-closed position and a valve-open position;

the tool includes an accumulator, in which fluid is stored at accumulator-pressure;

the tool includes a piston, which is connected to the pulse-valve-member;

the tool includes an area-divider, relative to which the piston is movable between a contact-position and a clear-position;

the piston has an accumulator-surface and an opposed formation-surface, and the tool is so structured that, the pulse-valve being open:

(a) accumulator-pressure acting on the accumulator-surface urges the piston to its clear-position; and (b) formation-pressure acting on the formation-surface urges the piston to its contact-position;

the tool includes structure that exerts a biassing-force on the piston in the direction to urge the piston towards the contact-position;

the tool is so structured that, the piston being in the contact-position:

(a) the accumulator-surface of the piston now makes sealing contact with the area-divider, thereby creating a divider-seal;

(b) the divider-seal sealingly divides the area of the accumulator-surface of the piston into two sub-areas, being area-A and area-B;

(c) the divider-seal, and the tool as a whole, are so structured as to enable the pressure to which area-A is exposed to be substantially different from the pressure to which area-B is exposed;

(d) only area-A of the accumulator-surface , and not area-B, is exposed to accumulator-pressure;

(e) when the pressure differential between accumulator-pressure and formation-pressure (PDAF) exceeds an upper trigger level, forces on the piston due to the PDAF acting over the area-A now exceed the biassing-force on the piston, whereby the piston now moves clear of the area-divider, towards the clear-position;

the tool is so structured that, the piston being in the clear-position:

(a) area-A and area-B are not now sealingly separated by the area-divider, but are now connected;

(b) whereby the accumulator-pressure now suddenly acts over the sum of area-A and area-B together;

(c) whereupon the piston now is subjected to a sudden force of sufficient magnitude to move the piston and to move the valve-member to the valve-open position.

2. As in claim 1, wherein the tool is so structured that, in use:

(a) when the pulse-valve is open:—

(i) a charge-volume of fluid now passes from the accumulator, through the open pulse-valve, and out into the formation;

(ii) whereby now the accumulator-pressure decreases, and the formation-pressure increases; and (iii) whereby now the PDAF decreases;

(b) when the pulse-valve is closed:

(i) the accumulator now is re-charged with fluid from a reservoir, whereby the accumulator-pressure increases;

(ii) the just-injected fluid leaks away into the formation, whereby the formation-pressure decreases;

(iii) whereby now the PDAF increases;

(c) the tool cycles between the valve-open position, in which the PDAF is decreasing towards a lower-trigger-level, and the valve-closed position, in which the PDAF is increasing towards the upper-trigger-level.

3. As in claim 2, wherein:

the fluid is liquid;

the structure of the tool is such that:

(a) when the pulse-valve is open, the PDAF exerts a pressure-force, PFopen, on the piston in the direction to open the pulse-valve, of magnitude $$PF\text{open}=PDAF*(\text{area-}A+\text{area-}B);$$

(b) when the pulse-valve is closed, the PDAF exerts a pressure-force, PFclosed, on the piston in the direction to open the pulse-valve, of magnitude $$PF\text{closed}=PDAF*\text{area-}A;$$

(c) throughout pulsing operation of the tool, the biasing-force BF acts on the piston in the direction to close the pulse-valve;

the upper-trigger-level of the PDAF is defined as the PDAF at which, the pulse-valve being closed, PFclosed=BF;

the lower-trigger-level of the PDAF is defined as the PDAF at which, the pulse-valve being open, PFopen=BF;

the charge-volume is the volume of liquid injected from the tool, per pulse, through the pulse-valve while the pulse-valve is open, and while the PDAF falls from the upper-trigger-level to the lower-trigger-level.

4. As in claim 1, wherein the tool is so structured that, in use:

(a) the magnitude of the biassing-force is:

(i) so large that, when the PDAF is at a relatively low level, the biassing-force provides sufficient force to drive the piston into the contact-position, against the PDAF;

(ii) so small that, when the PDAF is at a relatively high level, the PDAF provides sufficient force to drive the piston to the clear-position, against the biassing force;

(b) when the piston is in the contact-position:

(i) only area-A of the accumulator-surface of the piston is now exposed to the accumulator-pressure, not area-B;

(ii) when, the pulse-valve being closed and the accumulator having been re-charged, the rising PDAF has increased to the upper-trigger-level, the PDAF, acting over the area-A of the accumulator-surface of the piston, now exerts enough force on the piston to overcome forces biassing the piston into the contact-position, whereby the piston now moves to the clear-position;

(c) when the piston moves to the clear-position:

(i) the accumulator-surface of the piston being now clear of the area-divider, an area of the piston that is the sum of area-A and area-B of the accumulator-surface of the piston now becomes exposed to the PDAF;

(ii) whereupon the piston now is subjected to a sudden large force, acting to move the piston in the direction to open the pulse-valve.

5. Tool of claim 1, wherein the tool is operable to produce pulses in response to the tool being supplied with accumulator-pressure that is higher than the formation-pressure by an amount greater than the upper-trigger-level of the PDAF.

6. Tool of claim 1, wherein:

the piston being in the contact-position:

only area-A of the accumulator-surface is exposed to the accumulator-pressure, area-B being exposed to a lower pressure;

in that, either:

(a) the divider-seal is leak-proof; or (b) the area-B is vented to the formation; or (c) both.

7. Tool of claim 1, wherein:

the piston is connected to the pulse-valve-member at a lost-motion connection;

in the lost-motion connection, the piston and the valve-member are able to move relatively over a lost-distance;

the tool is so structured that, the PDAF having reached the upper-trigger-level, and the piston having moved clear of the area-divider:

(a) the valve-member at first does not move;

(b) upon the lost-distance being taken up, the piston picks up the valve-member, and the two then move in unison; and (c) the lost-distance is of sufficient magnitude to enable the piston to acquire momentum before the piston picks up the valve-member.

8. Tool of claim 1, wherein:

the tool includes a piston-seal;

the piston-seal seals the piston to a housing of the tool, between the accumulator-surface of the piston and the formation surface of the piston, both when the pulse-valve is open and when the pulse-valve is closed; and the area-B is the area enclosed between the divider-seal and the piston-seal when the pulse-valve is closed.

9. Tool of claim 1, wherein:

the pulse-valve includes a valve-seat, which is formed in a housing of the tool;

when the pulse-valve is closed, the valve-member lies pressed sealingly against the valve-seat;

when the pulse-valve is open, the open pulse-valve defines a window through the housing, through which fluid under pressure from the accumulator can pass outwards, in a radial direction;

and thence out into the formation.

10. Tool of claim 9, wherein:

the housing of the tool has a basically cylindrical overall configuration;

the tool is free from protrusions outside of the cylindrical configuration;

the tool is suitable, as a physical structure, to be lowered down into a cylindrical borehole in the ground; and the tool is operable while physically located down the said borehole.

11. Tool of claim 10, in combination with the borehole, wherein the borehole includes a tubular casing, and the injected fluid passes out of the borehole into the formation through perforations formed radially in the casing.

12. As in claim 1, wherein the fluid is liquid.

13. As in claim 12, wherein:

the accumulator includes structure that resiliently applies compressive force to a stored-volume of liquid in the accumulator;

the tool is so structured that:

(a) the stored-volume is located close to the pulse-valve; and, (b) when the pulse-valve opens, the stored-volume is available for rapid discharge through the pulse-valve.

14. As in claim 12, wherein:

the tool includes an equalization-hole, through which, the piston being in its contact-position, area-B of the accumulator-surface of the piston communicates with formation-pressure;

whereby, area-B being exposed to the lower pressure, the lower pressure equals formation-pressure.

* * * * *